US012760502B2

(12) United States Patent
Ye et al.

(10) Patent No.: US 12,760,502 B2
(45) Date of Patent: Oct. 13, 2026

(54) FAUCET

(71) Applicant: Xiamen Lota International Co., Ltd., Xiamen (CN)

(72) Inventors: Liming Ye, Xiamen (CN); Shuanglin Bai, Xiamen (CN); Chuanbao Zhu, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 18/533,418

(22) Filed: Dec. 8, 2023

(65) Prior Publication Data

US 2025/0059737 A1 Feb. 20, 2025

(51) Int. Cl.
*E03C 1/04* (2006.01)

(52) U.S. Cl.
CPC ..... *E03C 1/0402* (2013.01)

(58) Field of Classification Search
CPC ..... E03C 1/0401; E03C 1/0402; E03C 2001/0416
See application file for complete search history.

(56) References Cited

U.S. PATENT DOCUMENTS 5,381,830 A * 1/1995 Niemann ..... E03C 1/0401 285/280
5,465,749 A 11/1995 Sauter et al.
6,792,629 B2 * 9/2004 Nelson ..... E03C 1/0401 4/695
7,698,755 B2 4/2010 McNerney et al.
8,763,175 B2 * 7/2014 Li ..... E03C 1/0402 4/677
8,881,755 B2 11/2014 Thomas et al.
8,925,571 B2 1/2015 Li et al.
9,051,719 B2 6/2015 Li et al.
9,109,350 B2 8/2015 Zhu et al.
9,303,391 B2 4/2016 Leichty et al.
9,376,791 B2 6/2016 Wilkerson et al.
9,689,148 B2 6/2017 Zou et al.
9,702,126 B1 7/2017 Feher
9,932,726 B2 * 4/2018 Song ..... E03C 1/0402
11,060,267 B2 7/2021 Mooren et al.
11,136,749 B2 10/2021 Shen et al.
11,408,156 B2 8/2022 Zhang et al.
11,702,823 B2 7/2023 Benstead
12,054,926 B1 8/2024 Ding
(Continued)

FOREIGN PATENT DOCUMENTS

CN 103243782 A * 8/2013 ..... E03C 1/0402
CN 203296119 U 11/2013
(Continued)

*Primary Examiner* — Erin Deery
(74) *Attorney, Agent, or Firm* — Barnes & Thornburg LLP

(57) ABSTRACT

A faucet comprises a faucet body, a mounting base, and a locking assembly. The locking assembly is disposed on a lower side of the mounting base, and the mounting base is operatively connected to the locking assembly. At least part of the locking assembly is configured to be controlled to abut a lower side of a countertop, and the mounting base comprises a buckle member. A lower end of the faucet body is configured to be sleeved outside the mounting base, and the lower end of the faucet body comprises a buckle hole. The buckle member is operatively buckled to the buckle hole.

22 Claims, 11 Drawing Sheets

(56) References Cited

U.S. PATENT DOCUMENTS

| | | | | |
|---|---|---|---|---|
| 12,065,812 | B2 | 8/2024 | Currey et al. | |
| 2007/0001067 | A1 * | 1/2007 | Becker | F16B 13/0808 248/121 |
| 2019/0284785 | A1 | 9/2019 | Mu et al. | |

FOREIGN PATENT DOCUMENTS

| | | | | |
|---|---|---|---|---|
| CN | 205224184 | U | 5/2016 | |
| EP | 4119733 | A1 * | 1/2023 | E03C 1/0402 |

* cited by examiner

FAUCET

RELATED APPLICATIONS

This application claims priority to Chinese patent application number 202311028859.9, filed on Aug. 16, 2023. Chinese patent application number 202311028859.9 is incorporated herein by reference.

FIELD OF THE DISCLOSURE

The present disclosure relates to the field of sanitary ware, and in particular to a faucet.

BACKGROUND OF THE DISCLOSURE

Installation of conventional faucets is usually carried out under a countertop, so it requires professionals to bend over for a long time, squat, or lie in a dark and narrow space under a basin and use a variety of special tools to complete the installation. This installation method, which requires going under the countertop for assembly and locking, is time-consuming and laborious for faucet installers.

A quick installation mechanism for a faucet on a countertop has been disclosed in the prior art, which comprises a mounting base, a screw rod, a nut, a lifting base that rises and falls as the screw rod and nut rotate relative to each other, and two lever rotating arms. The mounting base comprises an installation hole, and the screw rod is disposed on one side of the installation hole. The two lever rotating arms are pivotally connected to the lifting base. This method of installing the faucet from above the countertop makes the faucet assembly simple, and the faucet housing of the faucet can be installed to the mounting base after the mounting base and the lifting base are fixedly connected to the countertop, so it can be applied to faucets of various structures. In addition, this method only uses a single screw, occupying the smallest space in the installation hole, so that a faucet hose can pass through the installation hole smoothly. This mechanism can be used not only in the installation of the faucet on the countertop, but is also be suitable for various styles of faucets, and can provide a large installation space. It has the advantages of simple structure, reliability, small installation space occupied, and low cost.

After the structure is installed on the countertop, the faucet needs to be fixed with side locking screws. The exposed screws are prone to moisture and rust and may malfunction over time, causing the faucet to shake. Moreover, the locking and removal of the screws require the use of a wrench. If the wrench is lost, the screws cannot be disassembled or locked. Therefore, the above-mentioned previous disclosure still has certain shortcomings, and installation and disassembly are relatively inconvenient.

Moreover, for some faucets with a pull-out pipe or water outlet pipes, when the pull-out pipe is installed on the mounting base, the pull-out pipe will rub against other parts, causing wear and tear over time.

BRIEF SUMMARY OF THE DISCLOSURE

The present disclosure provides a faucet to solve the deficiencies in the background.

In order to solve the technical problem, a first technical solution of the present disclosure is as follows. A faucet comprises a faucet body, a mounting base, and a locking assembly. The locking assembly is disposed on a lower side of the mounting base, and the mounting base is operatively connected to the locking assembly. At least part of the locking assembly is configured to be controlled to abut a lower side of the countertop, and the mounting base comprises a buckle member. A lower end of the faucet body is configured to be sleeved outside the mounting base, and the lower end of the faucet body comprises a buckle hole. The buckle member is operatively buckled to the buckle hole.

In a preferred embodiment, the mounting base comprises a guiding through hole, and the lower end of the faucet body is further disposed with a connecting seat. The connecting seat comprises a guiding tube extending downward, and a pull-out pipe is configured to pass through the guiding tube. The guiding tube is guided and slid in the guiding through hole, and when the faucet body is sleeved outside the mounting base, the guiding tube at least extends out of the mounting base.

In a preferred embodiment, the lower end of the faucet body is disposed with a connecting seat, and the connecting seat comprises an operation button extending out of the faucet body. The operation button is configured to be pressed by an external force to be moved radially inward so as to enable the buckle member at least to be pushed by the operation button to move radially to leave the buckle hole.

In a preferred embodiment, the connecting seat comprises a fixed seat matched with the lower end of the faucet body, and the fixed seat comprises the operation button. The lower end of the faucet body further comprises an operating through hole through which the operation button passes.

In a preferred embodiment, the buckle member is configured to be elastically deformed and rotated around a lower end of the buckle member, and the buckle member comprises a buckle protrusion. An outer side of an upper end of the buckle member comprises a matching slot, and the operation button is configured to be elastically deformed and rotated around an upper end of the operation button. A lower end of the operation button is matched with the matching slot, and when the operation button is pressed to move radially inward by the external force, the lower end of the operation button pushes the upper end of the buckle member to move radially inward so that the buckle protrusion leaves the buckle hole.

In a preferred embodiment, the mounting base further comprises a first protrusion or a first notch spaced apart from the buckle member, and the first protrusion or the first notch is matched with and connected to the lower end of the faucet body.

In a preferred embodiment, the buckle hole and the operating through hole are arranged side by side along an up-and-down direction.

In a preferred embodiment, the mounting base further comprises a middle through hole, and a water inlet pipe and a water outlet pipe are configured to pass through the middle through hole.

In a preferred embodiment, the mounting base further comprises a base body and a position-limiting sleeve, and the position-limiting sleeve is sleeved outside the base body. The base body correspondingly abuts an upper side of the countertop, and an outer side wall of the base body comprises a groove. The position-limiting sleeve comprises the buckle member, and the buckle member is configured to be elastically deformed radially to correspondingly extend into or out of the groove.

In a preferred embodiment, the position-limiting sleeve further comprises a position-limiting notch, and the base body comprises a position-limiting protrusion. When the position-limiting sleeve is sleeved outside the base body, the position-limiting notch is matched with position-limiting protrusion to inhibit a relative position of the position-limiting sleeve and the base body.

In a preferred embodiment, the locking assembly comprises a threaded rod, a moving member, and an abutting member, and the threaded rod is rotatably disposed on the mounting base. The moving member is threadedly connected to the threaded rod, and when the threaded rod rotates, the moving member moves up and down along the threaded rod to abut the lower side of the countertop.

Compared with the existing techniques, the technical solution has the following advantages.

The faucet is easy to assembly and disassemble.

The base body comprises a guiding through hole, and the lower end of the faucet body is further disposed with the connecting seat. The connecting seat comprises the guiding tube extending downward, and the guiding tube is used to receive the pull-out pipe. The guiding tube is guided and slid in the guiding through hole. When the faucet body is sleeved outside the mounting base, the guiding tube at least passes through the mounting base. The guiding tube not only serves as an installation guide, but further prevents friction and wear between the pull-out pipe and other components, thus protecting the pull-out pipe.

DETAILED DESCRIPTION OF THE EMBODIMENTS

Figure 1:
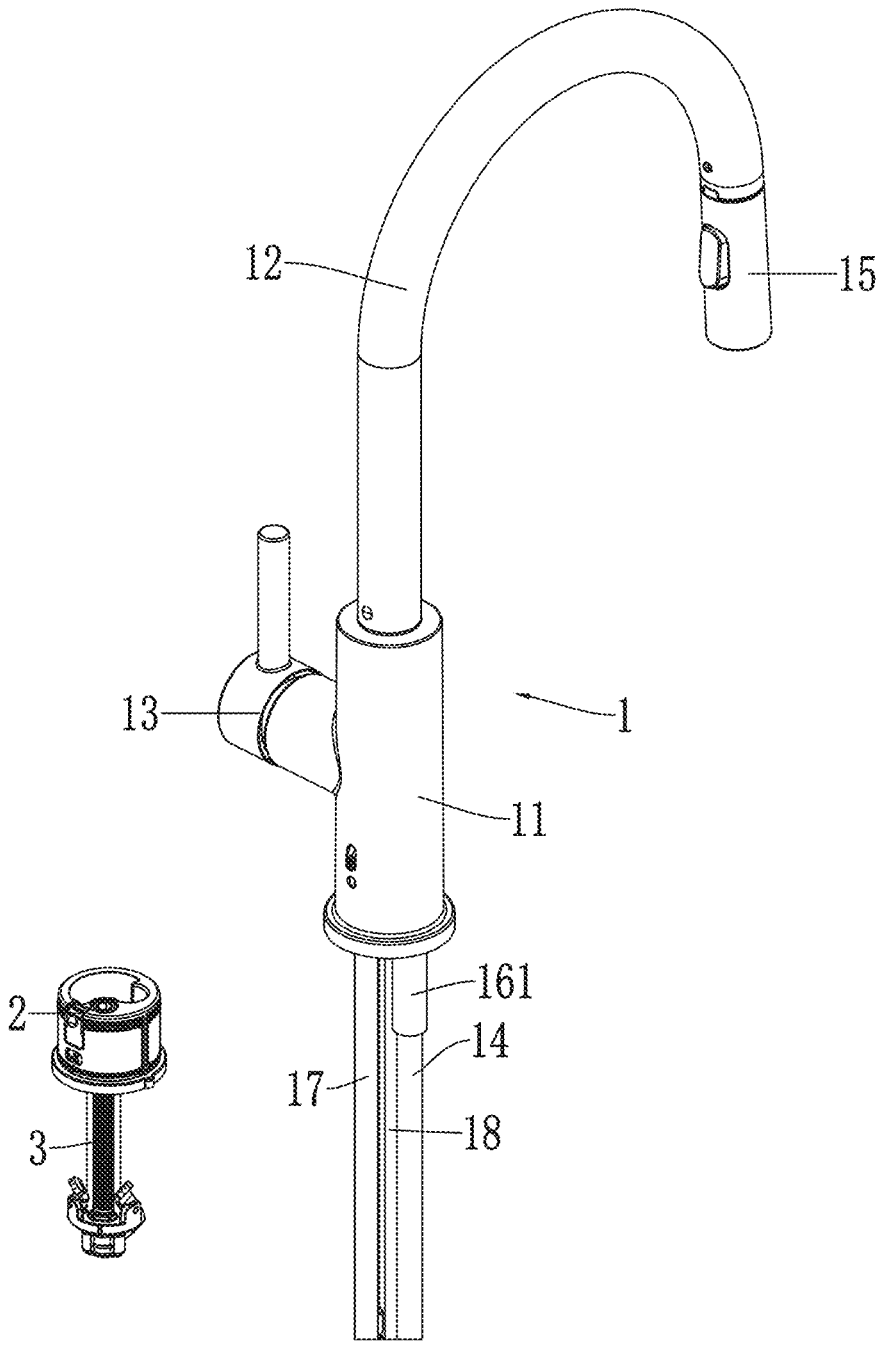
FIG. 1 illustrates a perspective view of a faucet in a preferred embodiment of the present disclosure.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Referring to FIG. 1-11, a faucet comprises a faucet body 1, a mounting base 2, and a locking assembly 3.

The faucet body 1 comprises a faucet base 11, a faucet bent tube 12, and a valve member 13 disposed in the faucet base 11. The faucet bent tube 12 is rotatably disposed on the faucet base 11. The valve member 13 is a conventional control valve. The faucet body 1 further comprises a water inlet pipe 17 and a water outlet pipe 18 connected to the valve member 13. The valve member 13 is connected to the water inlet pipe 17 to receive water from the water inlet pipe 17 to control the water to be connected to the water outlet pipe 18. Each of the water inlet pipe 17 and the water outlet pipe 18 extends out of a lower end of the faucet base 11. The faucet body 1 further comprises a pull-out pipe 14 and a water outlet head 15. The pull-out pipe 14 is connected to the water outlet pipe 18 and extends through the faucet base 11 and the faucet bent tube 12. A distal end of the pull-out pipe 14 is connected to the water outlet head 15. A user can pull the water outlet head 15, and the pull-out pipe 14 slides inside the faucet base 11 and the faucet bent tube 12.

The locking assembly 3 is disposed on an underside of the mounting base 2. The mounting base 2 is operatively connected to the locking assembly 3, and at least part of the locking assembly 3 is configured to be controlled to abut a lower side of a countertop. The locking assembly 3 comprises a threaded rod 31, a moving member 32, and an abutting member 33. The threaded rod 31 is rotatably disposed on the mounting base 2, and the moving member 32 is threadedly connected to the threaded rod 31. When the threaded rod 31 rotates, the moving member 32 can move up and down along the threaded rod 31 to abut the lower side of the countertop. The locking assembly 3 further comprises a blocking head 34 and two guiding pins 35. The blocking head 34 is located below the mounting base 2, the two guiding pins 35 are connected between the blocking head 34 and the mounting base 2, and the moving member 32 is slidably disposed on the two guiding pins 35. When the threaded rod 31 rotates, the moving member 32 can only move up and down along the threaded rod 31 due to the two guiding pins 35 until the abutting member 33 fixedly abuts the lower side of the countertop. The abutting member 33 comprises two rotating rods or tabs 331, which are respectively rotatably connected to two sides of the moving member 32. A rotation center of each of the two rotating rods 331 deviates from a middle position of each of the two rotating rods 331. Therefore, the two rotating rods 331 are subjected to gravity to rotate downward. When an upper end of each of the two rotating rods 331 contacts the lower side of the countertop, the two rotating rods 331 will rotate accordingly until the two rotating rods 331 entirely abut the lower side of the countertop. This is a conventional structure and will not be described again here.

An upper end of the threaded rod 31 comprises a connection interface 311. The connection interface 311 is a hexagonal socket. The connection interface 311 is located on an upper side of the mounting base 2. Therefore, the user can directly operate the threaded rod 31 above the countertop to achieve the connection between the locking assembly 3 and the countertop. The countertop is clamped between the mounting base 2 and the locking assembly 3.

The mounting base 2 comprises a base body 21 and a position-limiting sleeve 22.

Figure 2:
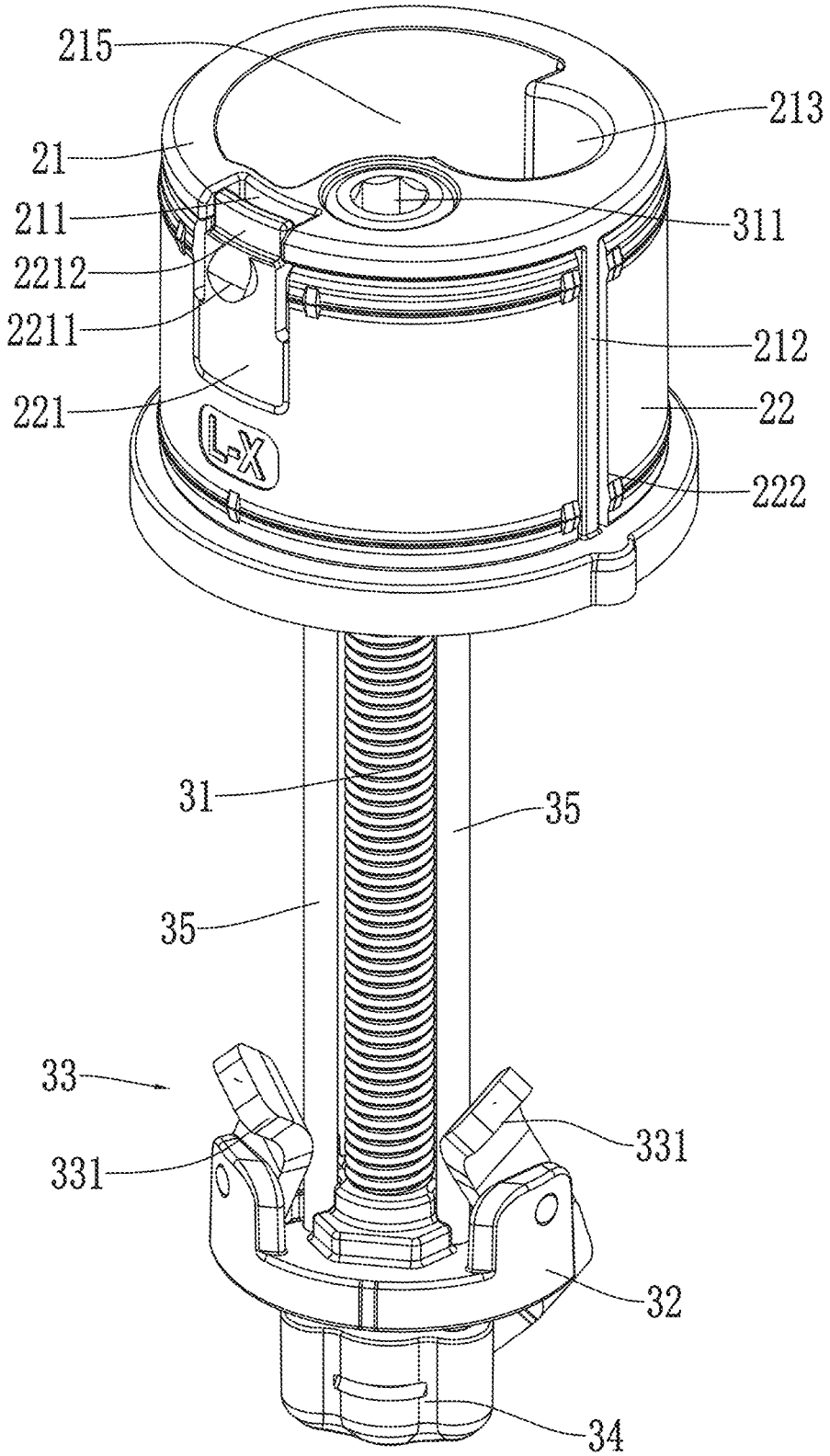
FIG. 2 illustrates a perspective view of a mounting base and a locking assembly in the preferred embodiment of the present disclosure.
Figure 3:
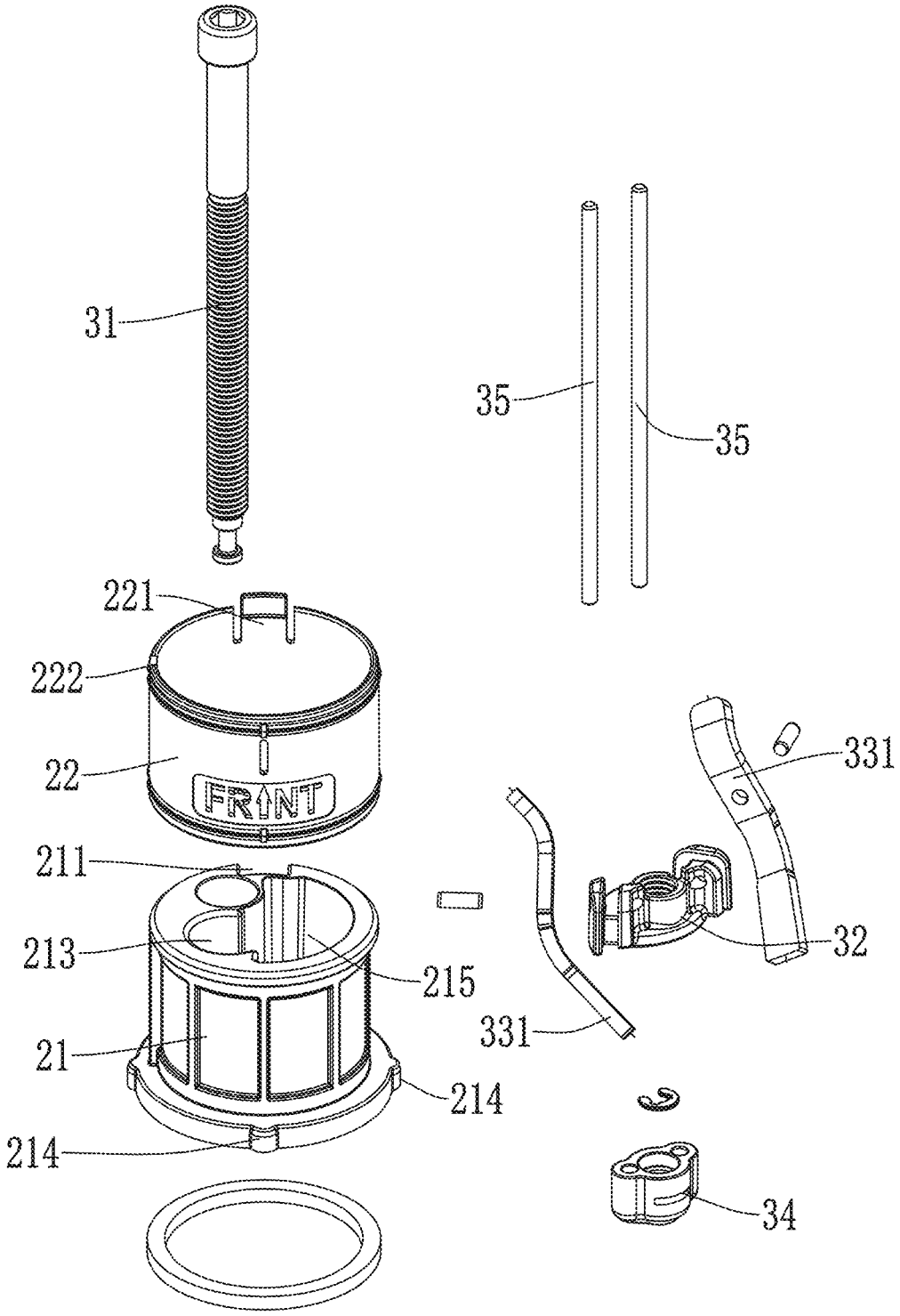
FIG. 3 illustrates a perspective and exploded view of the mounting base and locking assembly in the preferred embodiment of the present disclosure.
Figure 4:
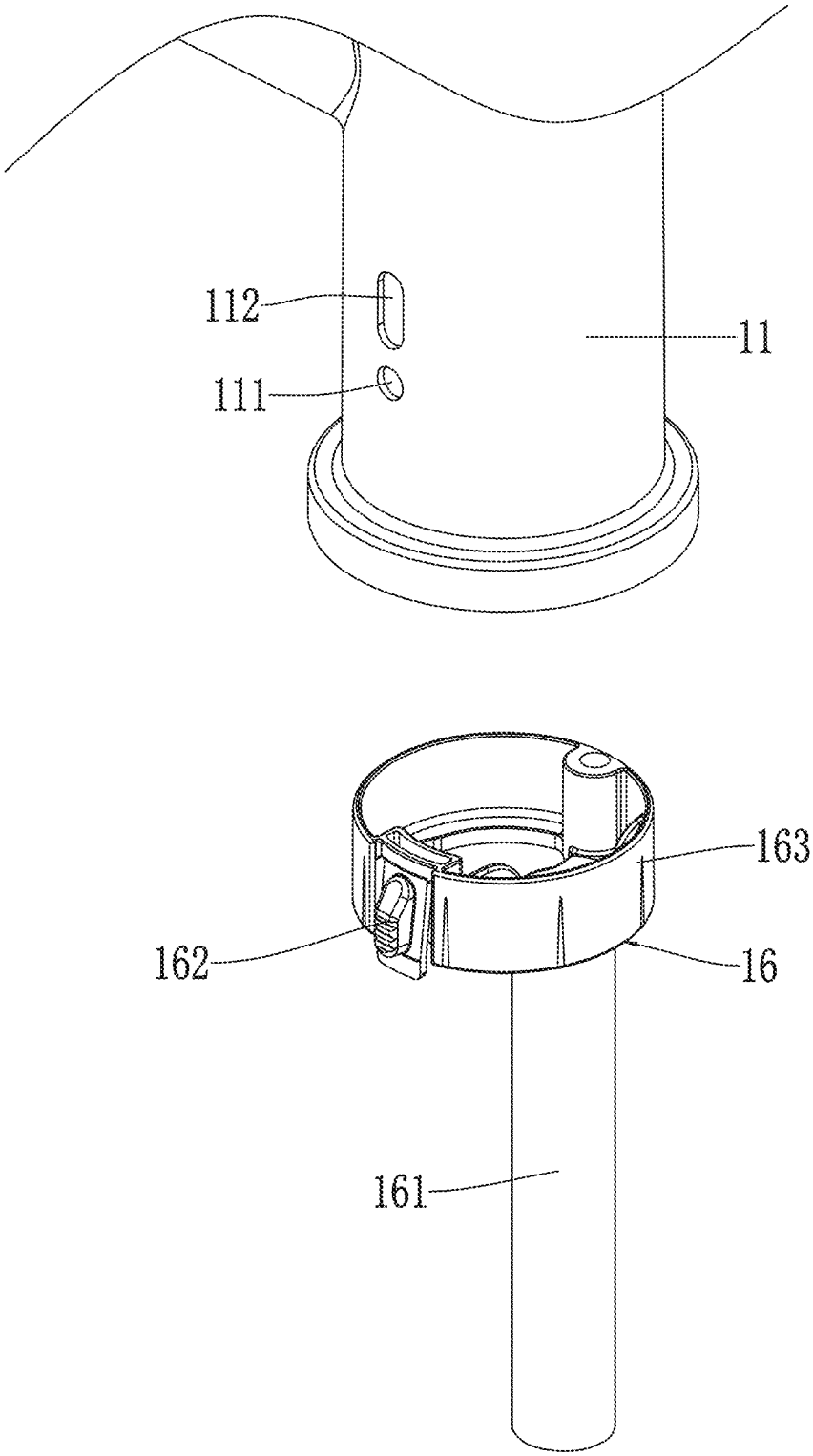
FIG. 4 illustrates a perspective and exploded view of a faucet base and a connecting seat in the preferred embodiment of the present disclosure.
Figure 5:
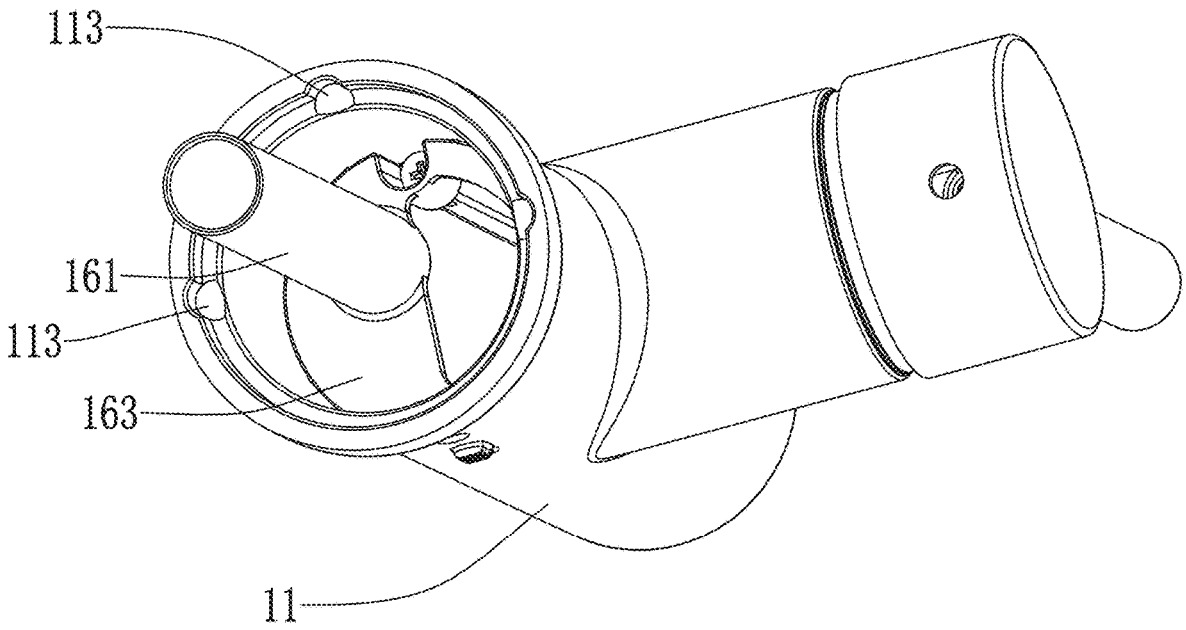
FIG. 5 illustrates a perspective view of the faucet base and connecting seat in the preferred embodiment of the present disclosure.
Figure 6:
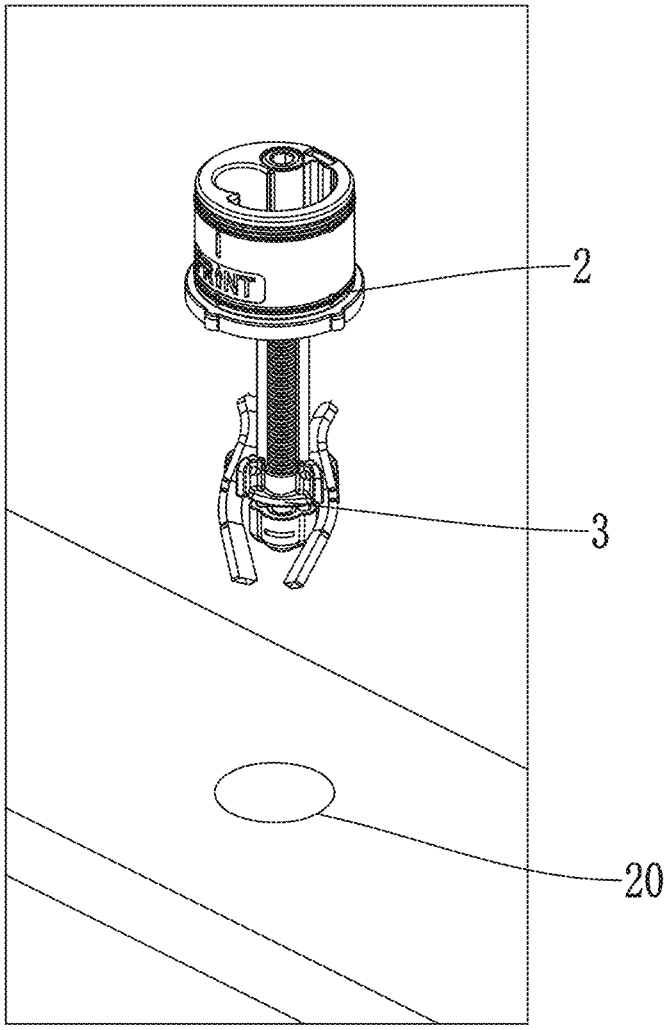
FIGS. 6-9 illustrate schematic diagrams of an installation process of the faucet in the preferred embodiment of the present disclosure.
Figure 7:
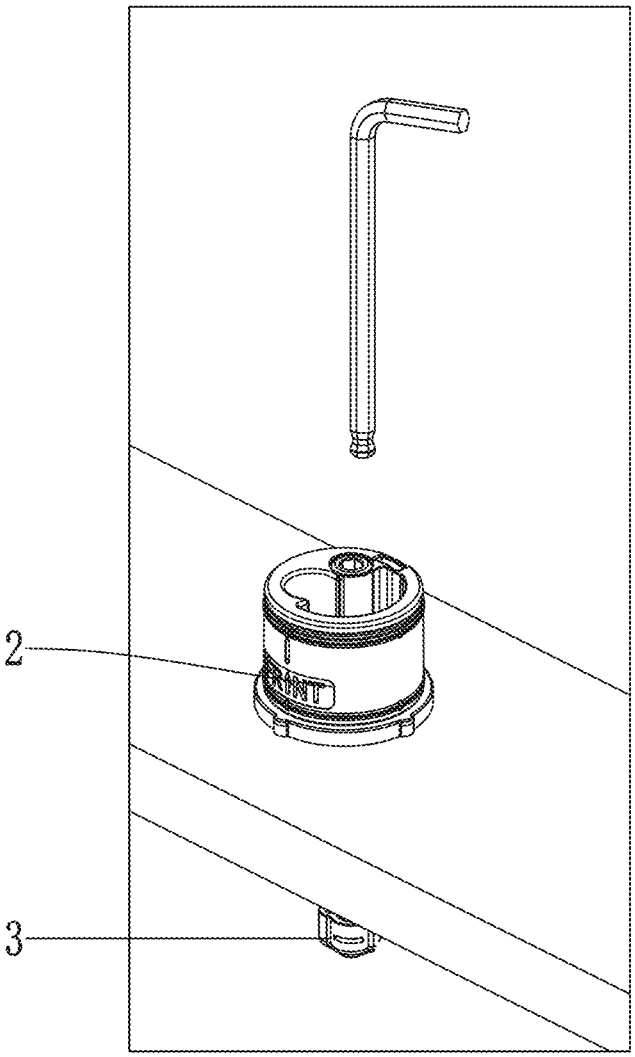
Figure 8:
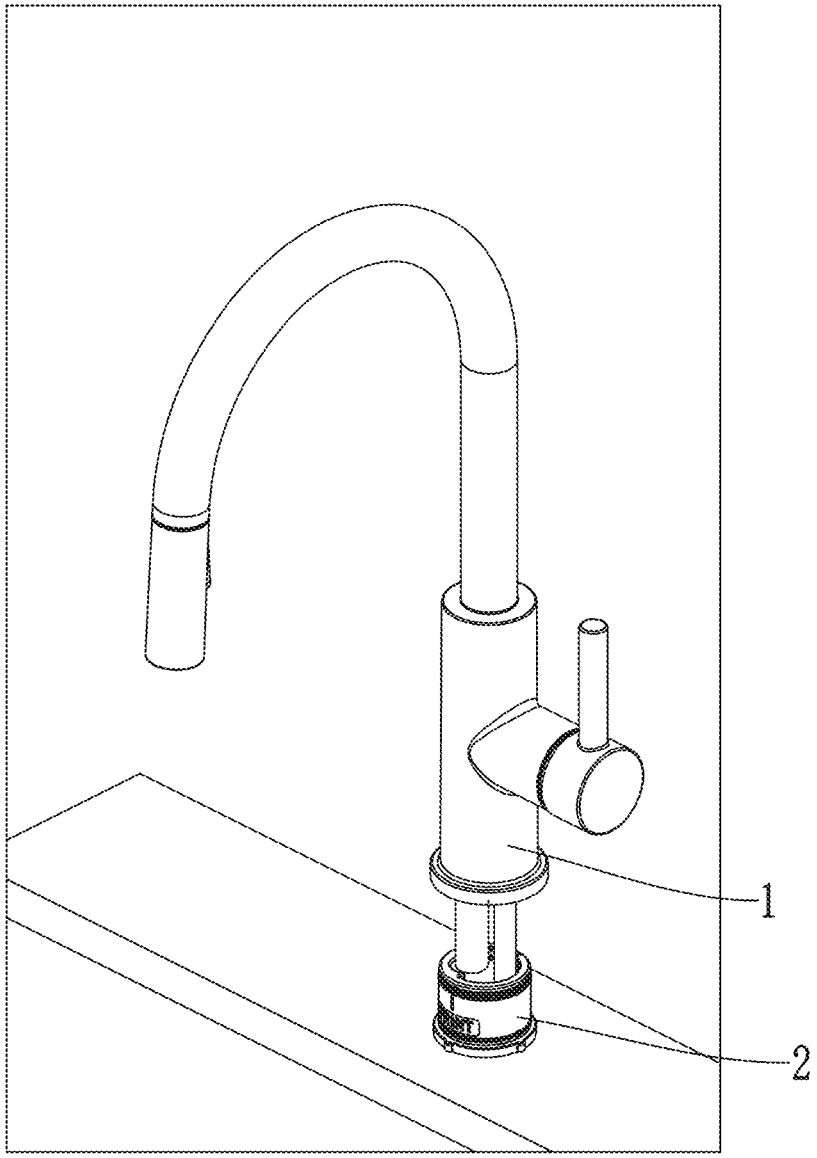
Figure 9:
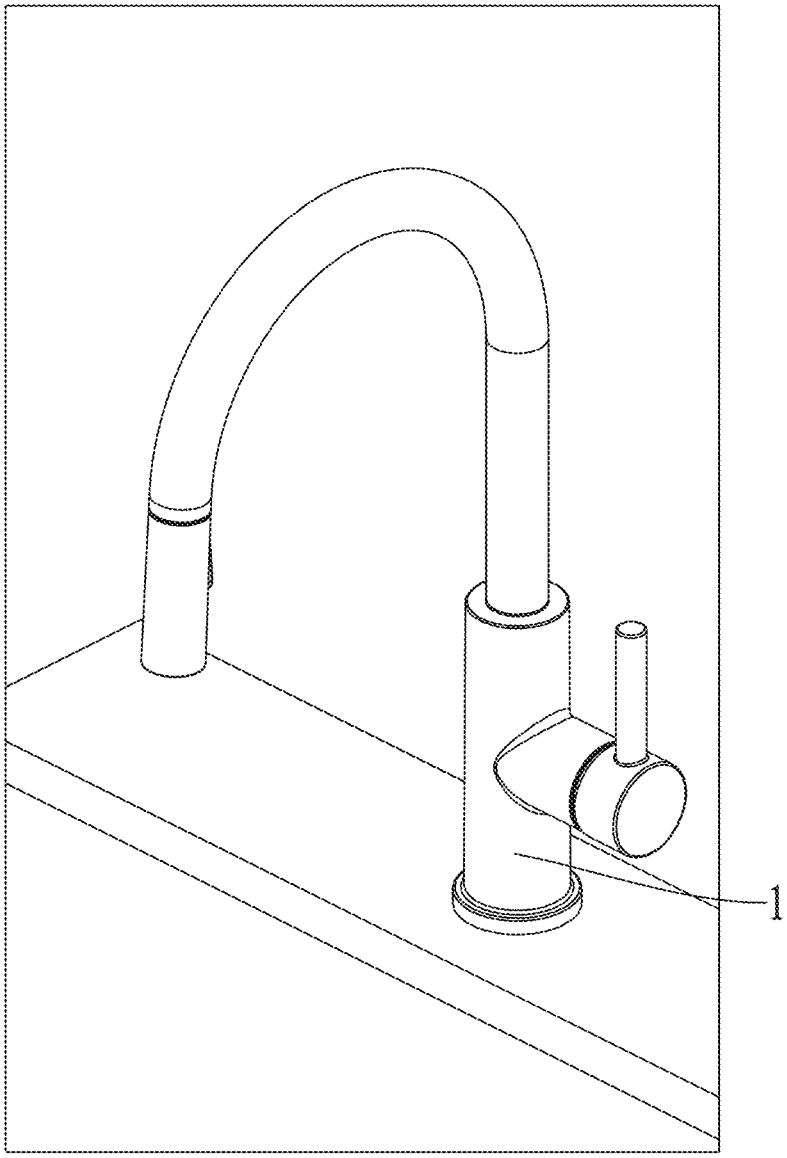
Figure 10:
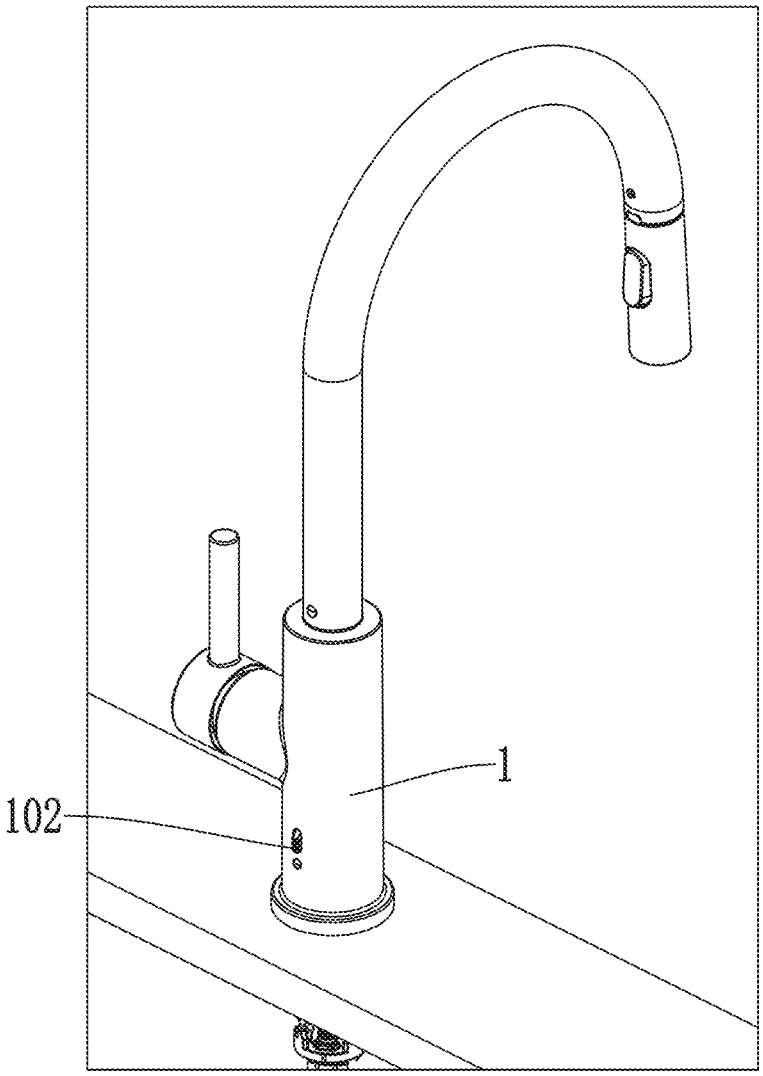
FIGS. 10-11 illustrate schematic diagrams of a disassembly process of the faucet in the preferred embodiment of the present disclosure.
Figure 11:
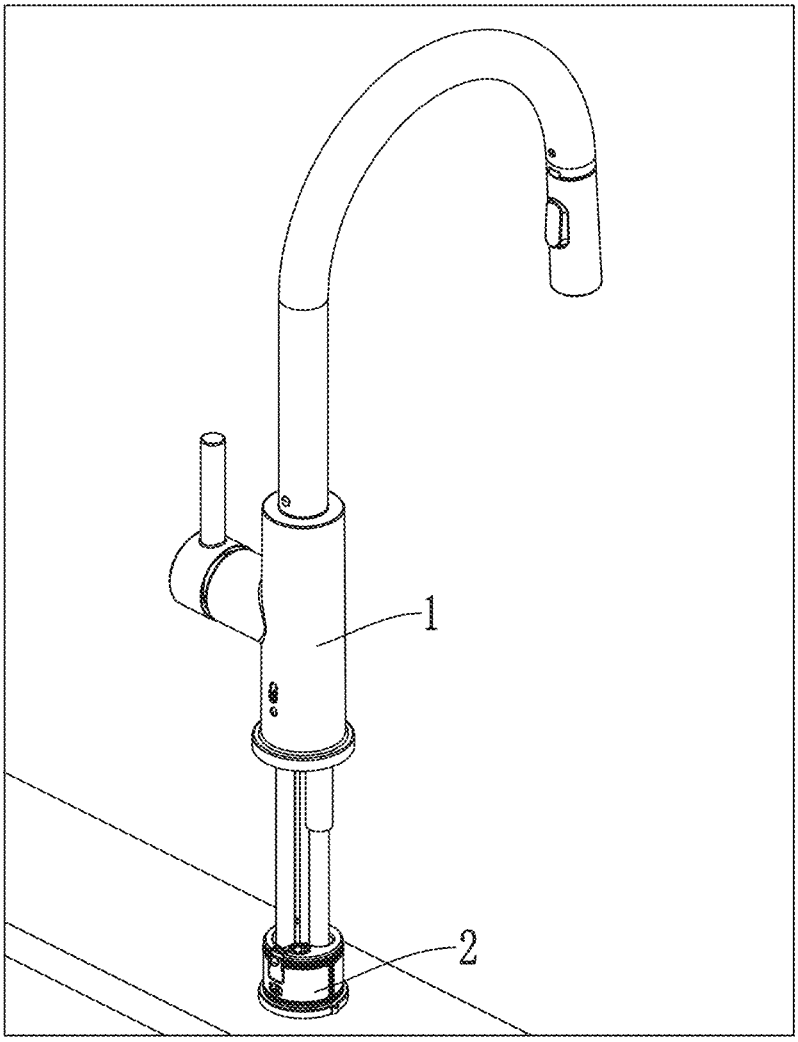

Referring to FIGS. 2 and 3, the position-limiting sleeve 22 is sleeved or positioned outside of the base body 21. The base body 21 correspondingly abuts an upper side of the countertop. An outer side wall of the base body 21 comprises a groove 211, and the position-limiting sleeve 22 comprises a buckle member 221. The buckle member 221 can be elastically deformed in a radial direction of the base body 21 to correspondingly extend into or out of the groove 211. As shown in FIGS. 3, 5 and 8-11, the lower end of the faucet base 11 can be sleeved or positioned outside of the mounting base 2, such that the mounting base 2 resides within or radially inward of the lower end or portion of the faucet body 1. The lower end of the faucet base 11 comprises a buckle hole 111, and the buckle member 221 is operatively buckled to the buckle hole 111.

The position-limiting sleeve 22 further comprises a position-limiting notch 222, and the base body 21 comprises a position-limiting protrusion 212. As shown in FIG. 2, when the position-limiting sleeve 22 is sleeved outside the base body 21, such that the position limiting sleeve 22 is located radially outward of the base body 21, the position-limiting notch 222 is matched with position-limiting protrusion 212 to inhibit a relative position of the position-limiting sleeve 22 and the base body 21.

The base body 21 comprises a guiding through hole 213. The lower end of the faucet body 1 is further disposed with a connecting seat 16. The connecting seat 16 comprises a guiding tube 161 extending downwardly, and the pull-out pipe 14 is configured to pass through the guiding tube 161. The guiding tube 161 is guided and slid in the guiding through hole 213. When the faucet body 1 is sleeved outside the mounting base 2, the guiding tube 161 at least moves to below the countertop. The connecting seat 16 comprises an operation button 162 extending out of the faucet body 1. The operation button 162 can be pressed by an external force to be moved radially inward. The operation button 162 at least pushes the buckle member 221 to move inward in the radial direction of the base body 21 to leave the buckle hole 111. The connecting seat 16 comprises a fixed seat 163 fixedly matched with the lower end of the faucet body 1. The fixed seat 163 comprises the operation button 162, and the lower end of the faucet body 1 further comprises an operating through hole 112. The operation button 162 passes through the operating through hole 112. In this embodiment, the fixed seat 163 is fixedly connected to the faucet base 11 through one or more screws.

The buckle member 221 can be elastically deformed and rotated around a lower end of the buckle member 221. The buckle member 221 comprises a buckle protrusion 2211. An outer side of an upper end of the buckle member 221 comprises a matching slot 2212. The operation button 162 can be elastically deformed and rotated around an upper end of the operation button 162, and a lower end of the operation button 162 is matched with the matching slot 2212. When the operation button 162 is pressed by an external force to rotate radially inward, the operation button 162 can rotate radially inward, and the lower end of the operation button 162 pushes the upper end of the buckle member 221 to move radially inward so that the buckle protrusion 2211 leaves the buckle hole 111. In this embodiment, the buckle hole 111 and the operating through hole 112 are disposed side by side along an up-and-down direction.

The base body 21 further comprises at least one disruption in a lower flange of the base body 21, such as a first protrusion 214 or a first notch circumferentially spaced apart from the buckle member 221. The at least one disruption (e.g., first protrusion 214 or the first notch) is connected to a cooperatively dimensioned mating feature, such as a second notch 113 or a second protrusion of the lower end of the faucet body 1.

The base body 21 comprises a middle through hole 215 for receiving the water inlet pipe 17 and the water outlet pipe 18. In this embodiment, the guiding through hole 213 is connected to the middle through hole 215.

During an assembly process, the locking assembly 3 first passes through the mounting hole 20 on the countertop until the mounting base 2 abuts the upper side of the countertop. Subsequently, the threaded rod 31 is rotated with a tool, so that the moving member 32 moves upward until the abutting member 33 fixedly abuts the lower side of the countertop. Subsequently, the water inlet pipe 17 and the water outlet pipe 18 of the faucet body 1 are passed through the middle through hole 215, and the guiding tube 161 is correspondingly inserted into the guiding through hole 213. Subsequently, the faucet base 11 is pressed down so that the buckle member 221 is connected to the buckle hole 111. During a disassembly process, the operation button 162 is pressed inward. At this time, the buckle member 221 is disconnected from the buckle hole 111, and the faucet base 11 can be pulled upward.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A faucet, comprising:

a faucet body, a mounting base including:

a base body having a position-limiting protrusion, wherein an outer side wall of the base body comprises a groove, and a position-limiting sleeve having a position-limiting notch, and wherein (i) the position-limiting sleeve is sleeved outside the base body, (ii) when the position-limiting sleeve is sleeved outside the base body, the position-limiting notch is matched with position-limiting protrusion to inhibit a relative position of the position-limiting sleeve and the base body, (iii) the position-limiting sleeve includes a buckle member, and (iv) the buckle member is configured to be elastically deformed radially to correspondingly extend into or out of the groove, and a locking assembly operatively connected to the mounting base, the locking assembly including a rotatable, threaded rod that is disposed in the mounting base, and wherein (a) at least part of the locking assembly is configured to be controlled to abut a lower side of a countertop and the base body correspondingly abuts an upper side of the countertop, and (b) a lower end of the faucet body is configured to be sleeved outside the mounting base.

2. The faucet according to claim 1, wherein the mounting base further comprises a first protrusion or a first notch, and wherein the first protrusion or the first notch is matched with and connected to the lower end of the faucet body.

3. The faucet according to claim 1, wherein the locking assembly comprises a moving member and an abutting member, and wherein (i) the moving member is threadedly connected to the threaded rod, and (ii) when the threaded rod rotates, the moving member moves up and down along the threaded rod to abut the lower side of the countertop.

4. A water faucet, comprising:

a faucet body, a mounting base including:

a base body having an outer side wall and a lower flange, wherein (a) the outer side wall extends from the lower flange to an upper top wall, (b) the outer side wall defines a first outer diameter and the lower flange defines a second outer diameter that is greater than the first outer diameter, (c) the lower flange includes at least one disruption and the faucet body includes a cooperatively dimensioned mating feature, and (d) the at least one disruption of the lower flange engages with the cooperatively dimensioned mating feature of the faucet body in an installed faucet position on a countertop, and a sleeve extending circumferentially around a portion of the outer side wall, wherein a protrusion extends outward from the sleeve that engages with a portion of the faucet body in the installed faucet position, and a locking assembly operably connected to the mounting base, the locking assembly including:

a threaded rod that is adapted to rotate, the threaded rod having a connection interface configured to receive a tool inserted by a user during installation of the mounting base on the countertop, a moving member operably connected to the threaded rod, wherein a position of the moving member along an axis of the threaded rod is adjusted in response to rotation of the threaded rod, and an abutting member operably connected to the moving member, wherein, in the installed faucet position, (i) the mounting base resides against an upper surface of the countertop, (ii) the abutting member resides against a lower surface of the countertop, (iii) the connection interface of the threaded rod is recessed from the top wall of the mounting base, and (iv) the mounting base resides within a lower portion of the faucet body.

5. The water faucet of claim 4, wherein the locking assembly also includes at least one guide pin that extends vertically alongside the threaded rod, and wherein the moving member is slidably disposed on the guide pin.

6. The water faucet of claim 5, wherein the locking assembly also includes a blocking head operatively coupled to a distal end of the threaded rod opposite the connection interface.

7. The water faucet of claim 6, wherein the at least one guide pin is coupled to the blocking head.

8. The water faucet of claim 4, wherein the locking assembly also includes a pair of guide pins that extend from the mounting base, wherein the threaded rod is located between the guide pins, and wherein the moving member is slidably displaced along the guide pins.

9. The water faucet of claim 4, wherein the abutting member includes at least one tab movably connected to the moving member, and wherein the tab resides against the lower surface of the countertop in the installed faucet position.

10. The water faucet of claim 4, wherein the mounting base includes an aperture that receives an upper segment of the threaded rod, whereby the upper segment of the threaded rod is accessible to a user during installation of the faucet, and wherein the upper segment of the threaded rod includes an upper end having the connection interface.

11. The water faucet of claim 4, wherein the sleeve also includes a buckle member, and wherein the protrusion extends from the buckle member that facilitates connection of the mounting base within the faucet body.

12. The water faucet of claim 4, wherein the at least one disruption of the lower flange is one of a first protrusion or a first notch, and wherein the cooperatively dimensioned mating feature of the faucet body is one of a second notch or a second protrusion.

13. A water faucet, comprising:

a faucet body with a faucet base, a valve member, and spout having a water discharge outlet, a mounting base including:

a base body having an outer side wall and a lower flange, wherein (a) the outer side wall defines a first outer diameter and the lower flange defines a second outer diameter that is greater than the first outer diameter, (b) the lower flange includes at least one disruption and the faucet body includes a cooperatively dimensioned mating feature, (c) wherein the at least one disruption of the lower flange engages with the cooperatively dimensioned mating feature of the faucet body in an installed faucet position on a countertop, and a sleeve extending circumferentially around a portion of the outer side wall, wherein the outer side wall extends from the lower flange to an upper top wall, wherein a protrusion extends outward from the sleeve that engages with a portion of the faucet body in the installed faucet position, and a locking assembly operably connected to the mounting base, the locking assembly including:

a threaded rod that extends from the mounting base, the threaded rod having a connection interface configured to receive a tool inserted by a user during installation of the mounting base on the countertop, a pair of guide pins that extend from the mounting base, a moving member operably connected to the threaded rod, wherein the moving member is displaced along the guide pins in response to rotation of the threaded rod, and wherein, in the installed faucet position, (i) the mounting base resides against an upper surface of the countertop, (ii) the connection interface of the threaded rod is recessed from the top wall of the mounting base, and (iii) the mounting base resides within a lower portion of the faucet base.

14. The water faucet of claim 13, wherein the moving member is also displaced along the threaded rod in response to rotation of the threaded rod.

15. The water faucet of claim 13, wherein the guide pins are arranged substantially parallel to each other.

16. The water faucet of claim 13, wherein the locking assembly also includes an abutting member operably connected to the moving member, and wherein the abutting member includes at least one tab pivotally connected to the moving member.

17. The water faucet of claim 16, wherein, in the installed faucet position, (iv) the abutting member resides against a lower surface of the countertop.

18. The water faucet of claim 13, wherein the mounting base includes an aperture that slidingly receives an upper segment of the threaded rod, whereby the upper segment of the threaded rod is accessible to a user during installation of the faucet, and wherein the upper segment of the threaded rod includes an upper end having the connection interface.

19. The water faucet of claim 13, wherein the sleeve also includes a buckle member, and wherein the protrusion extends from the buckle member that facilitates connection of the mounting base within the faucet base.

20. The water faucet of claim 13, wherein the locking assembly also includes a blocking head operatively coupled to a distal end of the threaded rod opposite the connection interface.

21. The water faucet of claim 20, wherein the guide pins are coupled to the blocking head.

22. The water faucet of claim 13, wherein the at least one disruption of the lower flange is one of a first protrusion or a first notch, and wherein the cooperatively dimensioned mating feature of the faucet body is one of a second notch or a second protrusion.

* * * * *